United States Patent [19]

Davis et al.

[11] 3,959,686

[45] May 25, 1976

[54] CATHODE RAY TUBE CONSTRUCTION HAVING DEFINED PROCESSING AND OPERATIONAL MEANS INCORPORATED THEREIN

[75] Inventors: Charles A. Davis; Anthony V. Gallaro, both of Auburn; Ralph E. Neuber, Seneca Falls, all of N.Y.

[73] Assignee: GTE Sylvania Incorporated, Stamford, Conn.

[22] Filed: Jan. 6, 1975

[21] Appl. No.: 538,506

[52] U.S. Cl. ..... 313/450; 313/479

[51] Int. Cl.[2] ..... H01J 29/02; H01J 31/00

[58] Field of Search ..... 313/450, 479

[56] References Cited

UNITED STATES PATENTS

| | | | |
|---|---|---|---|
| 2,409,514 | 10/1946 | Pratt | 313/450 |
| 2,483,457 | 10/1949 | Feldt et al. | 313/450 |
| 2,950,408 | 8/1960 | Ketchpel | 313/450 |
| 3,355,617 | 11/1967 | Schwartz et al. | 313/450 |
| 3,372,298 | 3/1968 | Merryman | 313/450 X |
| 3,746,904 | 7/1973 | Torre | 313/450 X |

*Primary Examiner*—Robert Segal
*Attorney, Agent, or Firm*—Norman J. O'Malley; Frederick H. Rinn; Robert T. Orner

[57] ABSTRACT

An improvement combination is provided in cathode ray tube construction for expediting improved tube processing and subsequent tube operation. The combination is incorporated in the funnel portion of the tube wherein a first low resistive electrical conductive coating is interiorly disposed in a substantially circumferential manner on the forward portion of the funnel nearest the screen. A high resistive electrical conductive coating is substantially circumferentially interiorly disposed on substantially the intermediate portion of the funnel being contiguous with the first coating, and making contact with a second low resistive electrical conductive coating interiorly disposed on substantially the rear portion of the funnel. This second coating extends into the forward region of the integral neck portion to facilitate electrical connection with the electron gun assembly positioned therein. A first button connector is oriented to traverse the wall of the forward region of the funnel and make connection with the first low resistive coating. Rearward from the first button, a second button connector traverses the wall of the funnel to provide a separate electrical connection for the second low resistive coating. During tube processing, utilization of this second button facilitates high voltage conditioning of the electron gun assembly by by-passing the high resistance coating; while in subsequent tube operation only the first button connector is utilized thereby effecting beneficial arc protection by incorporating the high resistive coating into the circuit.

4 Claims, 3 Drawing Figures

CATHODE RAY TUBE CONSTRUCTION HAVING DEFINED PROCESSING AND OPERATIONAL MEANS INCORPORATED THEREIN

BACKGROUND OF THE INVENTION

This invention relates to cathode ray tube construction and more particularly to an improvement combination means for expediting improved tube processing and subsequent tube operation.

The progressive development of cathode ray tube technology has included a trend toward the utilization of higher screen potentials along with the miniaturization and compaction of associated electron gun structures encompassed within envelope neck portions of decreased diameters. Consequently, the critically dimensioned spacings between related electrode components in the electron gun assemblies have been reduced in keeping with design parameters. The resultant minimization of these inter-electrode spacings, in conjunction with the high voltage differentials existant within the gun assembly, and the possible presence of contaminants, greatly increases the probabilities of arcing within the tube structure.

It has been conventional practice in cathode ray tube construction to apply a conductive coating on the interior surface of the funnel portion normally extending thereon from the vicinity of the screen into the forward region of the contiguous neck portion. This coating, which usually has a high positive electrical potential applied thereto, via connective means traversing the wall of the funnel, serves as a connective medium conveying that potential to both the screen and the terminal electrode of the related electron gun assembly oriented in the neck portion of the tube. The presence of this high potential increases the possibility of a spark discharge between the terminal electrode and the adjacent lower voltage electrodes in the gun assembly, especially in the presence of aggravating elements such as sublimation deposits, foreign particles, and minute projections extending into the interelectrode spacings. While considerable effort is expended during tube manufacturing to minimize the factors contributive to arcing, the utilization of anode potentials in the order of 30 KV and higher makes the possible presence of arc inducing conditions factors of extreme importance. It has been found that deleterious arcing or dielectric breakdown within the cathode ray tube may exhibit destructive intensities of 100 amperes or more. With the increased employment of solid state components in television and allied display devices, arcing within the cathode ray tube can produce catastrophic effects on the components in the associated operating circuitry of the display device. Additionally, an arc discharge may permanently damage the internal structure in the tube and sublime harmful metallic deposits in the region of the gun structure.

Cleanliness, precision, and care in tube manufacturing are ever-continuing procedures which are conscientiously employed to combat the materializing of conditions conducive for arcing. Nevertheless, human factors in conjunction with processing sublimates and manufacturing tolerances, sometimes combine to produce an undesirable arcing situation. One of the usual practices in tube processing is a step wherein portions of the electron gun assembly are subjected to high voltage conditioning. Such may be exemplarily accomplished by applying a high voltage potential in the order of 40 KV or more between the terminal high voltage electrode of the gun assembly and the adjacently spaced focusing electrode. The intent of this high voltage or sparking condition is to remove potential arcing projections and foreign matter from the inter-electrode spacing.

Another means for combating arcing within a tube has been the discrete usage of high resistance coatings applied to the interior area of the funnel. For example, one such technique is that disclosed by A. V. de Vere Krause in U.S. Pat. No. 2,829,292, wherein a band of resistive coating is internally applied to substantially the juncture region of the funnel and neck portions of the tube envelope to provide a high resistance area to limit the spark discharge current in the region of the electron gun. When employing coatings of this type within the tube, the resistance supplied thereby, being of a value sufficient to limit the current surge in the event of subsequent arcing, additionally limits the power of the high voltage conditioning procedure since the high resistive coating is in the circuit. Therefore, utilization of the resistive coating within the tube in an attempt to reduce subsequent arcing therein, hinders tube processing that is intended to minimize arcing. Since the minimization and elimination of arcing in present-day color cathode ray tubes is assuming ever increasing importance, it is a prime concern in tube manufacturing to achieve an expedient means for adequately controlling the probable arcing environment within the cathode ray tube per se.

OBJECTS AND SUMMARY OF THE INVENTION

It is an object of this invention to reduce and obviate the aforementioned disadvantages that have been evidenced in the prior art. Another object of the invention is to provide improved means for effecting improved internal arc suppression within the cathode ray tube. It is a further object of the invention to achieve improved tube processing and subsequent tube operation by providing means for inhibiting arcing within the tube in an expeditious and economical manner during tube fabrication.

These and other objects and related advantages are achieved in one aspect of the invention wherein improvement in arc suppression means comprises a combination including diverse resistive electrical conductive means and two separated funnel oriented electrical connective means, such being exemplarly in the form of: a funnel-disposed first low resistive electrical conductive coating, a sequentially applied high resistive electrical conductive coating followed by a second low resistive electrical conductive coating, a conjunctive first electrical connective means provides an electrical connection for the first low resistive coating, and a second electrical connective means is spatially oriented to provide a separate electrical connection for the second low resistive conductive coating. The first low resistive coating is of a composition similar to the conductive coating normally applied to the interior of the funnel portion, but in this instance, the first low resistive coating is restrictively disposed on substantially only the forward portion of the interior surface of the funnel. Sequentially the high resistive coating is contiguous to the first low resistive coating and is disposed on substantially the intermediate areal region of the interior surface of the funnel making contact with a second low resistive electrical conductive coating that is disposed on substantially the rear region of the interior surface of the funnel. This second low resistive coating extends into the forward region of the neck portion to facilitate electrical connection with the terminal electrode of the electron generating assembly located therein. A first electrical connective means, such as a conventional metallic button connector, is oriented to traverse the glass wall of the forward region of the funnel to provide an electrical connection with the first low resistive coating. Rearward therefrom, a second electrical connective means or button is oriented in a similar manner to traverse the wall of the funnel to provide a separate electrical connection for the second low resistive coating. A tube of this construction expeditiously facilitates high voltage conditioning during tube processing by utilizing the second electrical connective means to by-pass the high resistance coating in the tube. On the other hand, during subsequent tube operation, the benefit of the high resistive electrical conductive coating is advantageously employed in the circuit by utilizing the first electrical connective means. Thus, both processing and operational advantages are achieved by the combination of the invention to provide a finished tube which beneficially increases the dielectric breakdown protection for both the tube and the vulnerable associated circuitry.

DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

While the invention is applicable for utilization in conventional cathode ray tube employed in both monochrome and color television and allied image reproducing systems, for purposes of illustration, a color cathode ray tube utilizing a multi-apertured shadow mask and a plural beam electron generating assembly will be described in this specification.

Figure 1:
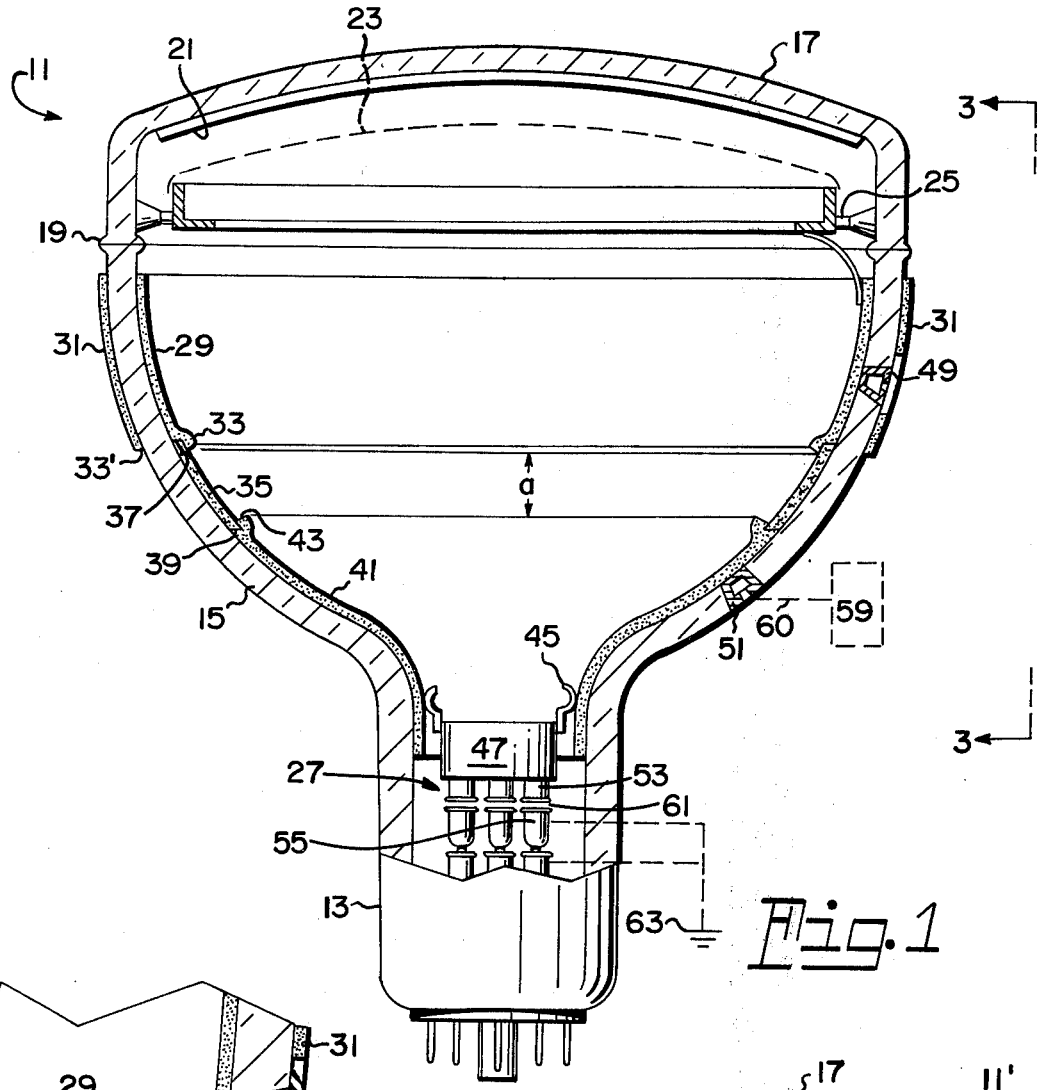
FIG. 1 is a cross-sectional view of a cathode ray tube employing the invention.

With particular reference to FIG. 1, a plural beam color cathode ray tube construction 11 is illustrated as having an envelope comprised of an integration of neck 13, funnel 15, and face panel 17 portions, the panel and funnel portions being hermetically integrated during tube fabrication along the congruent sealing region 19. A patterned cathodoluminescent screen of plural color-emitting phosphor areas 21, is disposed on the interior surface of the viewing panel as an array of definitive stripes or dots, in keeping with the state of the art. A multiapertured structure, in this instance, a shadow mask 23, having openings discretely shaped in keeping with the pattern of the screen, is oriented within the viewing panel, by a plurality of locator means 25, in spatial relationship to the patterned screen.

An exemplarily and partially detailed plural beam electron gun assembly 27 is positioned within the neck portion 13 of the envelope in a manner to project a plurality of electron beams, not shown, to conventionally converge at the shadow mask and thence impinge the patterned screen therebeyond.

It has been usual practice to dispose electrical conductive coatings on both the interior and exterior surfaces of the funnel portion of the tube. These two related coatings in conjunction with the intervening glass of the funnel form a capacitive filtering effect which is normally utilized in the operational circuitry of the associated television or image display device. Conventionally, the exteriorly applied coating is an electrical conductive material, such as Aquadag, suitably disposed on a portion of the external surface of the funnel extending from substantially the region adjacent the panel-funnel seal 19 to approximately the mid-region thereof. The related interiorly applied coating is likewise normally formed of a carbonaceous material, such as Aquadag, and usually has the common electrical potential of the screen and the terminal electrode member of the electron gun assembly applied thereto by a funnel-disposed electrical transversal or button which is electrically isolated from the exterior coating.

With reference to this invention, as illustrated in FIG. 1, a first low resistive electrical conductive coating 29 is disposed upon substantially the forward portion of the interior surface of the funnel 15, and as such is in substantially superposed relationship with the outer conductive coating 31 applied to the exterior surface of that portion of the funnel. The first low resistive interiorly disposed coating 29 extends rearward from substantially the region adjacent the panel-funnel transition 19 to a rear boundary 33 which may or may not be superpositionally related to the defined rear boundary 33' of the exteriorly disposed conductive coating 31. Continuing with the combination of the invention, a high resistive electrical conductive coating 35 is uniformly disposed in a circumferential manner to substantially the intermediate region of the interior surface of the funnel 15. This high resistive coating is applied in a manner to have a forward boundary 37 contiguously related to the rear boundary 33 of the first low resistive conductive coating 29 and a rear boundary 39 dimensionally removed from the forward boundary 37. The combination continues with a second low resistive electrical conductive coating 41 disposed in a substantially circumferential manner on substantially the rear region of the interior surface of the funnel 15. This second low resistive coating has a forward boundary 43 contiguously related to the rear boundary 39 of the high resistive coating 35 and extends areally therefrom into the forward region of the integrated neck portion 13, thereby facilitating electrical connection, through snubber means 45, with the terminal section or beam convergence structure 47 of the plural beam electron generating assembly 27 encompassed within the neck portion 13.

Constructioned features of the funnel portion 15 per se enter into the combination in that a first electrical connective means or button 49 is oriented to traverse the wall of the forward region of the funnel portion to provide an electrical connection therethrough thereby effecting contact with the first low resistive coating 29 disposed upon the interior surface thereof. A similarly formed second electrical connective means or button 51 is spatially related rearward of the first electrical connective means 49 and is likewise oriented to traverse the wall of the funnel portion 15. This second electrical connective means 51 is located to provide a separate electrical connection to effect contact with the second low resistive coating 41 disposed upon the interior surface of the rear region of the funnel portion.

The respective aforementioned coatings 29, 35, and 41 are of compositions known to the art. The first and second low resistive electrical conductive coatings 29 and 41, disposed substantially on the forward and rear sections of the funnel, may be of conventional carbonaceous materials such as Aquadag; such being circumferentially applied to discrete areas by means such as spraying or brushing techniques practiced in the art. The intermediate high resistive electrical conductive coating 35 is uniformly and tenaciously bonded to the interior surface of substantially the intermediate region of the funnel between those areas occupied by the first and second low resistive conductive coatings 29 and 41. The high resistive arc inhibiting coating 35 may be, for example, one of those comprised of a glass frit based composition having suitable metallic oxide inclusions. Such compositions are heat fused to the glass surface of the funnel to provide a bonded particle-free surface thereon prior to the deposition of the first and second low resistive conductive coatings. This circumferential area of high resistive coating 35 forms a predetermined resistive path between the first 29 and second 41 low resistive electrical conductive coatings and exhibits a low voltage DC resistance of an exemplary value in the order of 1.0 to 10.0 megohms. It has been found that resistances within the range of this magnitude markedly limit the current and inhibit initiation of possible arcs in an operating tube. In the normal operation of a tube of this type, peak arcing currents seldom exceed 0.5 to 1.0 amperes. In typical tube operation, the high positive voltage applied commonly to the anode and the terminal accelerating electrodes of the gun assembly, designated as 53, may be of a value in the order of 30 KV or more. Since the voltage on the adjacent focusing electrodes 55 in the gun assembly may be within the range of about 17 to 20 percent of the anode voltage, the interelectrode region 61, between the accelerating 53 and focusing 55 electrodes is prone to the initiation of arcing if conducive conditions are present. Thus, it is highly desirable to employ current limiting and arc inhibiting means such as afforded by the high resistive conductive coating 35 to effect protection for the gun assembly and the vulnerable conjunctive circuitry associated with the operating tube.

Further benefits of the improvement combination of the invention are evidenced during tube processing, wherein only the second low resistive coating 41 and the associated second electrical connective means 51 are utilized in high voltage conditioning thereby bypassing the high resistive electrical conductive coating in the funnel. The advantageous aspects are particularly evidenced during this high voltage processing step wherein a potential in the order of 40 KV or more, supplied from an external source 59 and phantomed in FIG. 1, is applied via a connective lead 60 to the second electrical connective means 51 which is in turn connected with the terminal accelerating electrodes 53 of the electron gun assembly 27. Usually the adjacent focusing electrodes 55 are collectively connected thereby effecting a high voltage sparking condition across the inter-electrode spacing 61 separating the high voltage accelerating electrodes 53 and the focusing electrodes 55, the connective circuitry to ground 63 being phantomed in FIG. 1. This high voltage conditioning beneficially destroys or minimizes microscopic sources of field emission such as foreign particles and inter-electrode projections which could contribute to deleterious arc conducive conditions during tube operation. By-passing the high resistive coating during processing protects the current limiting characteristics of that coating from possible breakdown or deterioration during the high voltage conditioning step.

Figure 2:
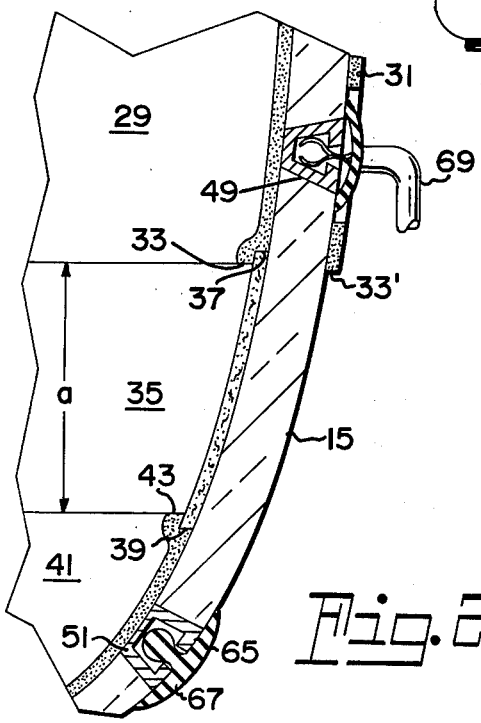
FIG. 2 is an enlarged partial sectional of the tube shown in FIG. 1 illustrating particularly the region wherein the first and second electrical connective means are oriented.

Upon the completion of tube processing, it is desirable to cover the external surface 65 of the second electrical connective means 51 with a protective cover or closure of insulative material 67 to eliminate a possible shock hazard during tube operation. As additionally shown in FIG. 2, the high voltage anode operational potential, from an external source not shown, is applied to the first electrical connective means 49 by a conventional shielded lead 69.

Figure 3:
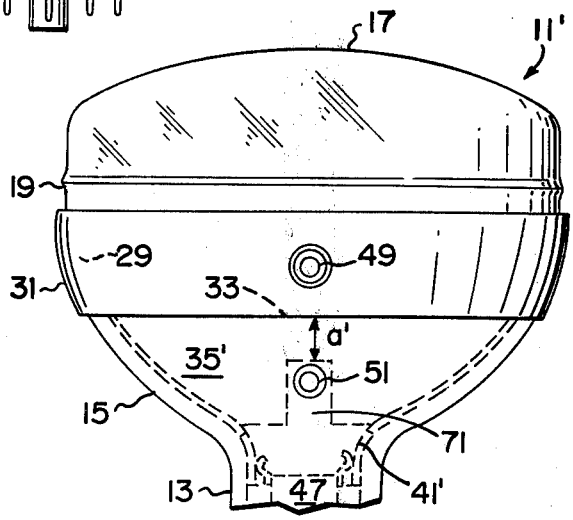
FIG. 3 is a cross-sectional view of a tube illustrating another embodiment of the invention taken from the viewpoint of the line 3—3 in FIG. 1.

Another embodiment or modification of the invention is shown in FIG. 3 which is a view of another tube 11′ oriented in a manner similar to reference line 3—3 as noted in FIG. 1. In this embodiment, the second low resistive conductive coating 41′ is disposed primarily on the interior of the funnel portion 15 on that region immediately adjacent to the neck portion 13. A peninsular strip 71 of the second conductive coating 41′ is extended partially into the area of the high resistive coating 35′ to make sole internal electrical contact with the second electrical conductive means 51 traversing the wall of the funnel. Whichever coating configuration, FIG. 1 or 3, is utilized, the dimensioning, whether it be *a* or *a′*, separating the rear boundary of the first low resistive conductive coating and the nearest portion of the second low resistive conductive coating is sufficient to provide an area of a high resistance coating 35 or 35′ that is of a value to limit possible spark discharge current in the region of the electron generating assembly to a non-deleterious value.

Thus, there is provided an improved cathode ray tube that is comprised of a structural combination, including diverse resistive electrical conductive means and two separated funnel oriented electrical connective means, which selectively not only affords a combination effecting improved internal arc suppression during tube operation, but also one wherein improved tube processing is also achieved. The advantageous effects of improved high voltage conditioning during processing and subsequent operational improvement resultantly produces a tube of superior quality.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a cathode ray tube having an envelope formed of a sequential integration of a forwardly oriented viewing panel, an intermediate funnel portion, and a rearward neck portion providing an enclosure for internal structural components including a multi-electrode electron generating assembly positioned in said neck portion in a manner to project at least one electron beam to impinge a cathodoluminescent screen disposed on the interior surface of said panel, said tube having an electrical conductive coating disposed on a portion of the exterior surface of said funnel beginning adjacent the transition region of the panel and funnel portions and extending rearward therefrom to a defined boundary on said funnel, said improvement being means for expediting improved tube processing and subsequent tube operation comprising in combination:

a first low resistive electrical conductive coating disposed in a substantially circumferential manner on substantially the forward portion of the interior surface of said funnel in substantially superposed relationship with at least a portion of said exterior conductive coating, said first coating extending rearward from substantially the region adjacent said panel-funnel transition to a rear boundary in substantially the mid-region of said funnel;

a high resistive arc-inhibiting electrical conductive coating having discrete resistive properties adherently disposed in a circumferential manner to substantially the intermediate region of the interior surface of said funnel to provide a bonded particle-free areal deposition, said resistive coating having a forward boundary contiguous to the rear boundary of said first low resistive conductive coating and a rear boundary dimensionally removed from said forward boundary;

a second low resistive electrical conductive coating disposed in a substantially circumferential manner on substantially the rear region of the interior surface of said funnel, said second low resistive coating having a forward boundary contiguous to the rear boundary of said high resistive coating and extending areally therefrom into the forward region of said integrated neck portion to facilitate electrical connection with the terminal section of said electron generating assembly;

first electrical connective means oriented to traverse the wall of the forward region of said funnel thereby providing an electrical connection therethrough to effect contact with said first low-resistive coating to provide an operational connection for facilitating an electrical path across said high resistive and said second low resistive coatings to said electron generating assembly; and second electrical connective means spatially related rearward of said first electrical connective means and oriented to traverse the wall of said funnel portion thereby providing a separate electrical connection therethrough to effect contact with said second low resistive coating for facilitating improved tube processing prior to tube operation.

2. The cathode ray tube improvement according to claim 1 wherein said second low resistive conductive coating is disposed primarily on the interior of said funnel portion on the region immediately adjacent said neck portion, and wherefrom a peninsular strip of said second conductive coating is extended partially into the area of said high resistive coating to make sole internal electrical contact with said second electrical connective means.

3. The cathode ray tube improvement according to claim 1 wherein said second electrical connective means is inactivated after tube processing and the external surface thereof protectively covered by closure means.

4. The cathode ray tube improvement according to claim 2 wherein the dimensioning separating the rear boundary of said first low resistive conductive coating and the nearest portion of said second low resistive conductive coating is sufficient to provide a resistance of a value to limit possible spark discharge current in the region of the electron generating assembly to a non-deleterious value.

* * * * *